US006938299B2

(12) United States Patent
Martinez et al.

(10) Patent No.: US 6,938,299 B2
(45) Date of Patent: Sep. 6, 2005

(54) WET-DRY VACUUM CLEANER WITH SECURELY NESTABLE TOOL HOLDER AND BASKET

(75) Inventors: David Martinez, Williamsport, PA (US); Robert Crevling, Cogan Station, PA (US)

(73) Assignee: Shop Vac Corporation, Williamsport, PA (US)

( * ) Notice: Subject to any disclaimer, the term of this patent is extended or adjusted under 35 U.S.C. 154(b) by 384 days.

(21) Appl. No.: 10/300,975

(22) Filed: Nov. 21, 2002

(65) Prior Publication Data

US 2004/0098822 A1 May 27, 2004

(51) Int. Cl.[7] ..... A47L 9/00
(52) U.S. Cl. ..... 15/323; 15/353
(58) Field of Search ..... 15/323, 353; 220/23.6, 220/23.83

(56) References Cited

U.S. PATENT DOCUMENTS

| | | | | | |
|---|---|---|---|---|---|
| 2,825,087 | A | * | 3/1958 | Meyerhoefer | 15/323 |
| 4,057,931 | A | * | 11/1977 | Stutelberg et al. | 47/83 |
| 4,653,638 | A | * | 3/1987 | Lackner et al. | 206/373 |
| 5,313,686 | A | * | 5/1994 | Berfield | 15/323 |
| 5,513,416 | A | * | 5/1996 | Bassler et al. | 15/323 |
| 5,528,794 | A | * | 6/1996 | Tomasiak | 15/323 |
| 6,070,288 | A | * | 6/2000 | Luyckx et al. | 15/323 |
| 6,098,241 | A | * | 8/2000 | Wood | 15/323 |
| 6,237,187 | B1 | * | 5/2001 | Hult et al. | 15/323 |
| 6,374,452 | B1 | * | 4/2002 | Essex et al. | 15/323 |
| 6,510,583 | B2 | * | 1/2003 | Griffin et al. | 15/323 |
| 2003/0024067 | A1 | * | 2/2003 | Roney et al. | 15/323 |
| 2003/0213090 | A1 | * | 11/2003 | Holsten et al. | 15/323 |

FOREIGN PATENT DOCUMENTS

GB 2349069 * 10/2000

OTHER PUBLICATIONS

Brochure of Shop Vac Corporation entitled "QSP Series Wet/Dry Vacs", Apr. 1999.
Brochure of Shop Vac Corporation entitled "No Other Vac has All of This", May 1, 2000.

* cited by examiner

*Primary Examiner*—Terrence R. Till
(74) *Attorney, Agent, or Firm*—Marshall, Gerstein & Borun LLP

(57) ABSTRACT

A wet-dry vacuum cleaner with both a tool caddy and a waste receptacle basket is disclosed which has a mechanism by which the basket can be securely and positively connected to the tool caddy. One of the tool caddy and basket may include a deflectable tab while the other of the tool caddy and basket may include a slot adapted to receive the tab. Upon connecting the basket onto the tool caddy the tab may be inserted into the slot to thus positively connect the basket to the tool caddy and thereby provide a secure attachment.

20 Claims, 11 Drawing Sheets

WET-DRY VACUUM CLEANER WITH SECURELY NESTABLE TOOL HOLDER AND BASKET

FIELD OF THE DISCLOSURE

The disclosure generally relates to vacuum cleaners and, more particularly, relates to wet-dry vacuum cleaners having tool holders attached thereto.

BACKGROUND OF THE DISCLOSURE

Wet-dry vacuum cleaners are commonly available tools which enable users to vacuum dry debris and liquid using the same tool. Such devices typically include a relatively large tank having a open top to which a lid is removably attached. A motor impeller unit is typically mounted within the lid to create the necessary vacuum for drawing wet and dry debris into the tank.

More recent versions of such vacuum cleaners have included tool holder accessories mounted to the outer wall of the tank. Such tool holders can be provided in a number of forms to enable hoses, nozzles, brushes, and other vacuum cleaner accessories, to be stored or mounted thereto when not in use. For example, such tool holders can extend outwardly from the side wall of the tank and include a number of upwardly extending appendages which are sized to receive each of the tools in a frictional arrangement.

Still further versions of such vacuum cleaners have been provided with waste receptacles or baskets which can be mounted directly on top of the tool holder to provide the user with a large open receptacle for storage of waste or other items. Such baskets, when used in conjunction with the above-referenced type of tool holder, typically include a bottom wall from which a continuous side wall upwardly extends to define an open top. A plurality of apertures are provided in the bottom wall and are sized and spaced so as to align with each of the appendages and thereby receive the appendages in a frictional interfit arrangement.

While effective, such tool holder and basket systems have been known to provide a less then satisfactory grip between the basket and the tool holder, thus enabling the basket to fall from the vacuum cleaner, thereby resulting in unnecessary mess and dissatisfaction on the part of the user.

SUMMARY OF THE DISCLOSURE

In accordance with one aspect of the disclosure, a wet-dry vacuum cleaner is disclosed which may comprise a tank, a motor impeller unit, a tool caddy, and a basket. The tank may have an outside wall while the motor impeller unit is mounted to the tank. The tool caddy is mounted to the outside wall and includes at least one slot. The basket is removably mounted to the tool caddy and includes at least one deflectable tab adapted to frictionally interfit into the tool caddy slot.

In accordance with another aspect of the disclosure, a method of assembling accessories onto a wet-dry vacuum cleaner is disclosed which may comprise the steps of mounting a tool caddy onto a tank of a wet/dry cleaner, and mounting a basket on top of the tool caddy. The tool caddy may include a plurality of appendages and at least one slot. The basket may have a continuous side wall extending upwardly from a bottom wall and defining a open top, while the bottom wall may include a plurality of apertures each of which may receive one of the tool caddy appendages when the basket is mounted onto the tool caddy. The basket may include a tab. The method may further include the step of positively connecting the basket with the tool caddy by engaging the tab into the slot.

In accordance with another aspect of the disclosure, a wet-dry vacuum cleaner is disclosed which may comprise a tank, a lid, a motor impeller unit, a tool caddy, a basket, and means for locking the basket onto the tool caddy. The tank includes a bottom wall and a continuous side wall extending upwardly from the bottom wall. The side wall defines a open top. The lid is mounted to the open top and the motor impeller unit is mounted in the lid. The tool caddy may be mounted against the tank side wall and include a plurality of appendages adapted to store vacuum tool accessories. The basket may be mounted to the tool caddy and include a bottom wall from which a side wall upwardly extends.

In accordance with another aspect of the disclosure, a wet-dry vacuum cleaner is disclosed which may comprise a tank, a lid, a motor impeller unit, a tool caddy, a basket, and at least one tab extending from one of the tool caddy and basket. The tank may include an open top with the lid being mounted to the open top and the motor impeller unit being mounted in the lid. The tool caddy is mounted to a wet-dry vacuum cleaner tank and include a plurality of appendages adapted to receive and store vacuum cleaner tools and accessories. The basket may be adapted to be mounted onto the top of the tool caddy and have a bottom wall from which a continuous side wall upwardly extends. The bottom wall may include a plurality of apertures adapted to receive the plurality of tool caddy appendages. At least one tab may extend from one of the tool caddy and basket while the other of the tool caddy and basket may include a slot adapted to receive the tab.

These and other aspects and features of the disclosure will become more apparent upon reading the following detailed description when taken in conjunction with the accompanying drawings.

Figure 1:
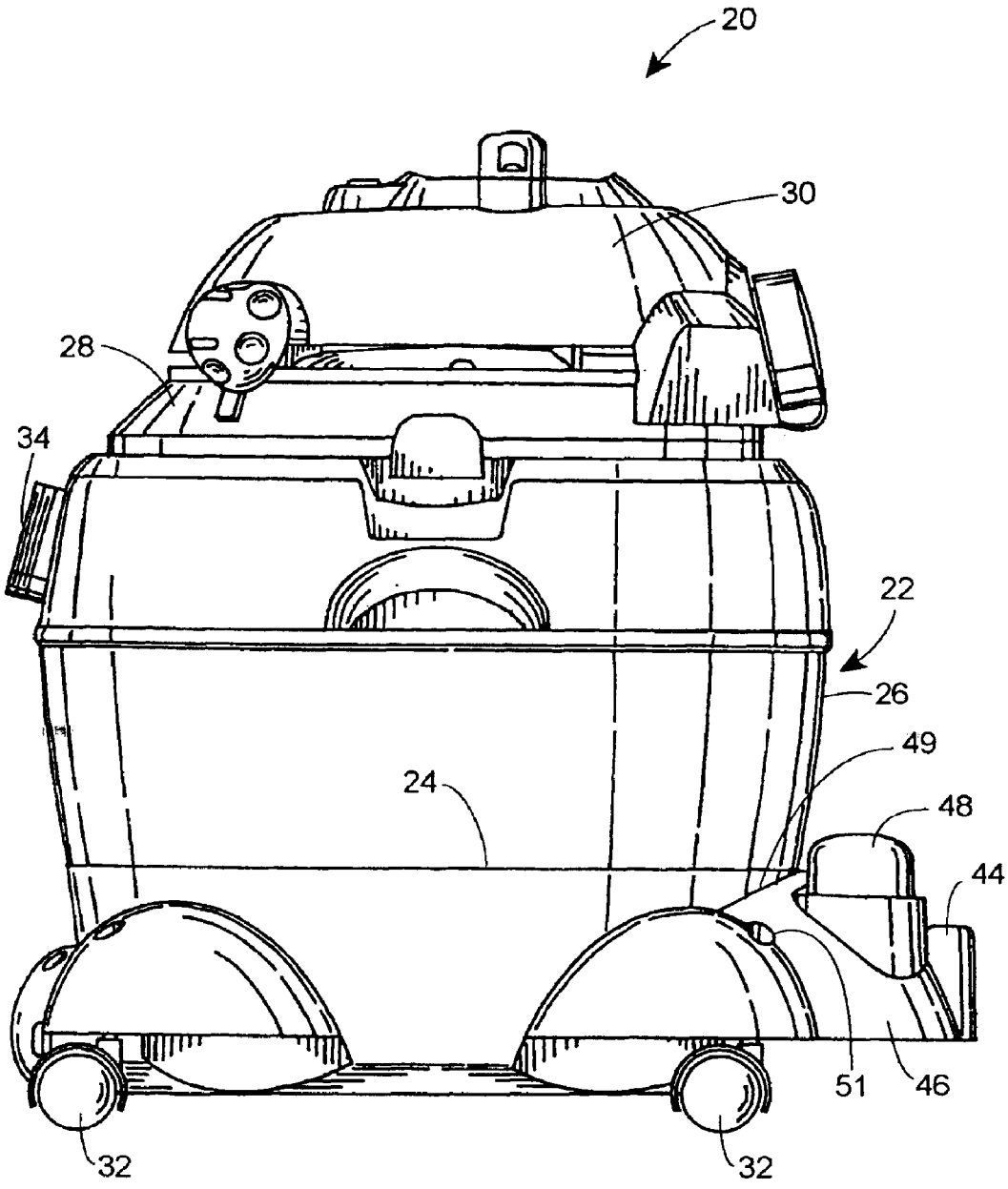
FIG. 1 is a side elevation view of a vacuum cleaner constructed in accordance with the teachings of the disclosure.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and equivalents falling within the spirit and scope of the invention as defined by the appended claims.

DETAILED DESCRIPTION OF THE DISCLOSURE

Referring now to the drawings, and with specific reference to FIG. 1, a vacuum cleaner constructed in accordance with the teachings of the disclosure is generally referred to by reference numeral 20. While the disclosure will be provided and the drawings depict, a wet-dry vacuum cleaner of the type adapted to vacuum dry debris and liquid, it is to be understood that the teachings of the disclosure can be used in conjunction with other types of vacuum cleaners as well as other types of appliances and tools wherein it is desirable to mount one accessory onto another in a stable and secure fashion.

Referring again to FIG. 1, the vacuum cleaner 20 is shown to include a tank 22 having a bottom wall 24 from which a side wall 26 upwardly extends and defines an open top (not shown) a lid 28 is mounted to the side wall 26 so as to close off the open top when desired. As is conventional, a motor impeller unit 30 is mounted within the lid to generate the necessary pressure differential within the tank 22 to create the vacuum. The tank 22 may further include a plurality of casters 32 to facilitate movement of the vacuum cleaner 20, as well as a drainage port, power cord (not shown), and flexible hose (not shown) in communication with the motor and impeller unit 30 to thus direct the created vacuum to the desired location to be cleaned. A vacuum port 34 is provided for attachment of the hose. A plurality of tool accessories, such as nozzles and brushes, can be mounted to a distal end of the hose as is conventional.

Figure 2:
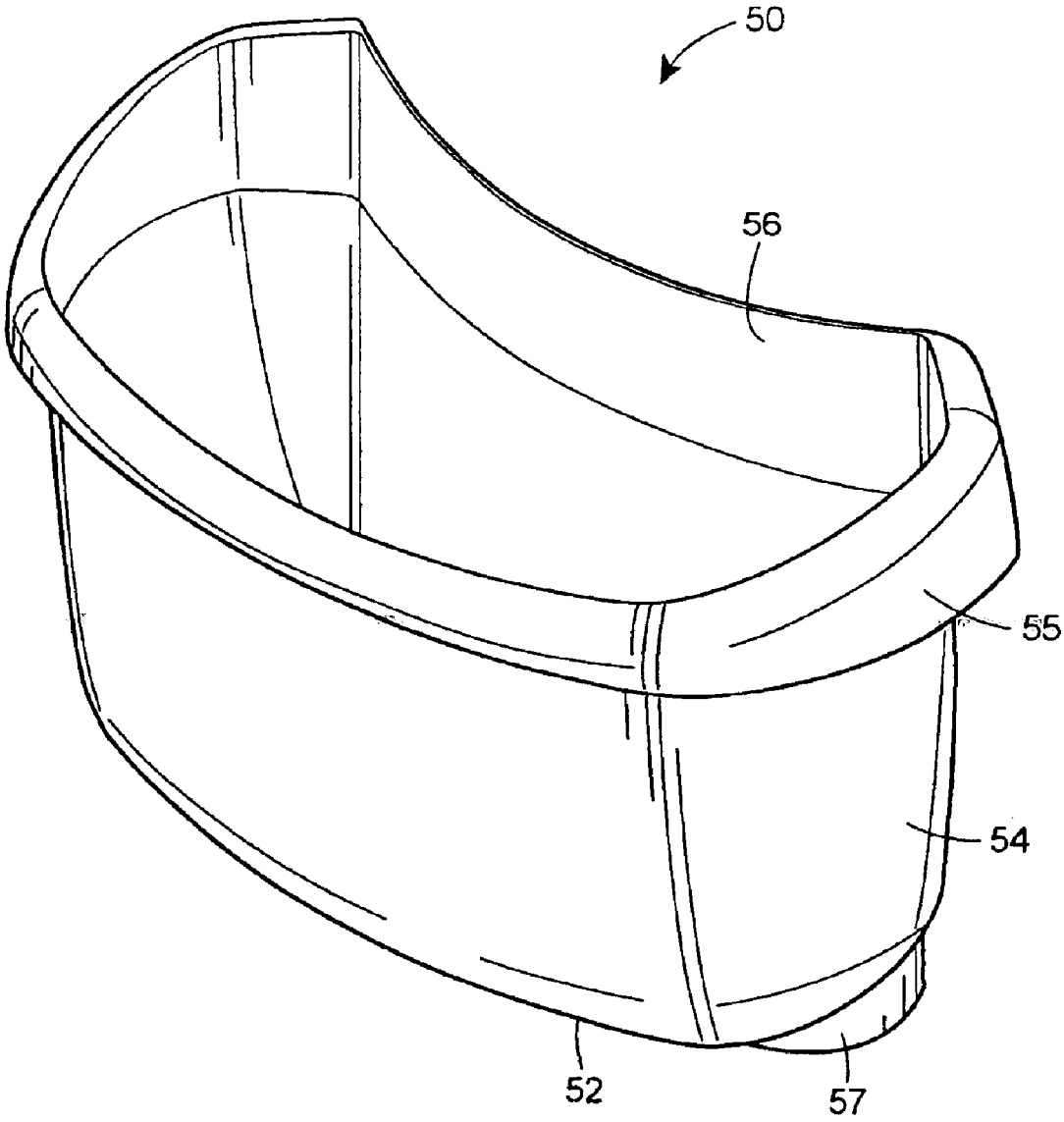
FIG. 2 is a perspective view of a basket constructed in accordance with the teaching of the disclosure.
Figure 3:
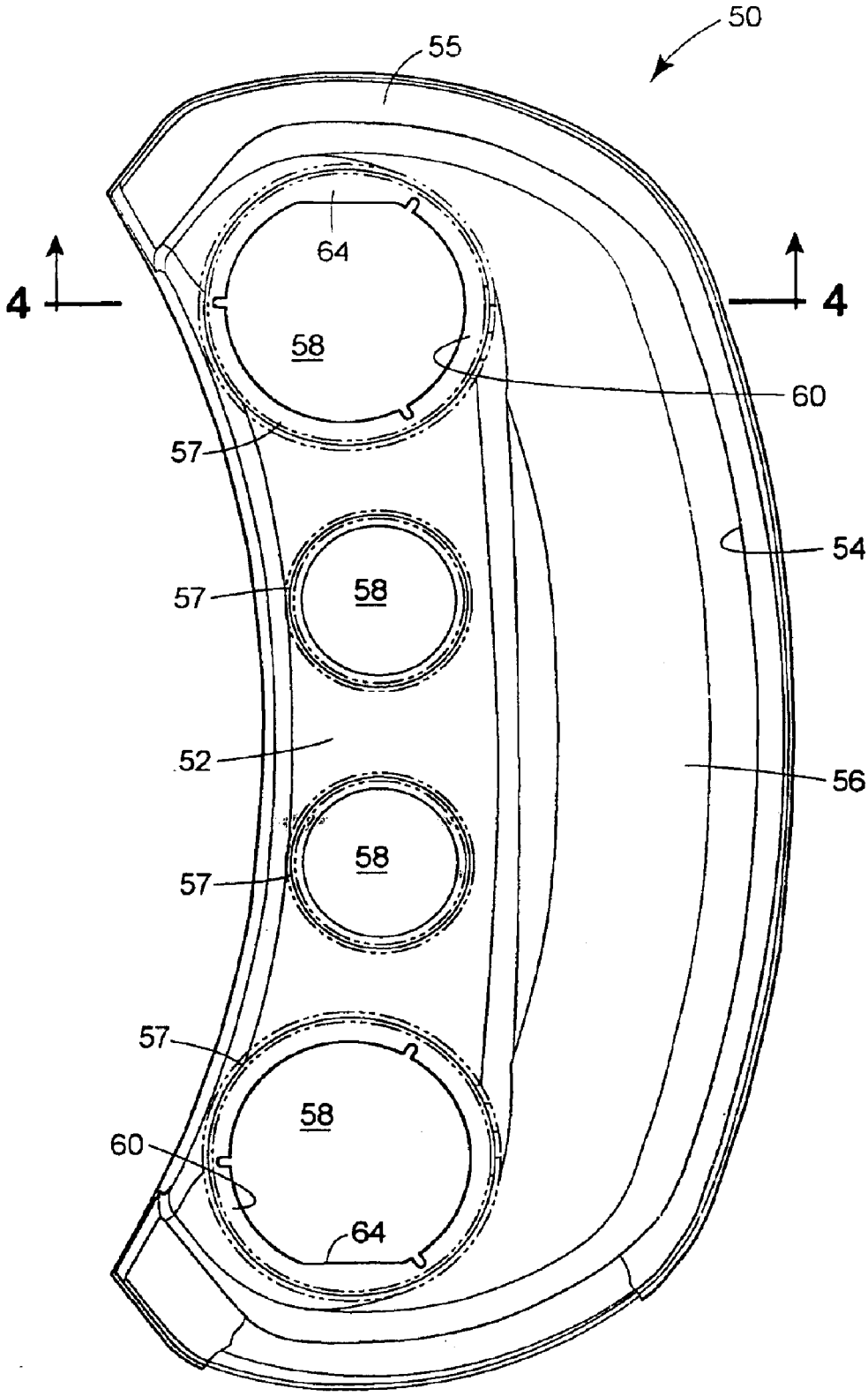
FIG. 3 is a top view of the basket of FIG. 2.
Figure 4:
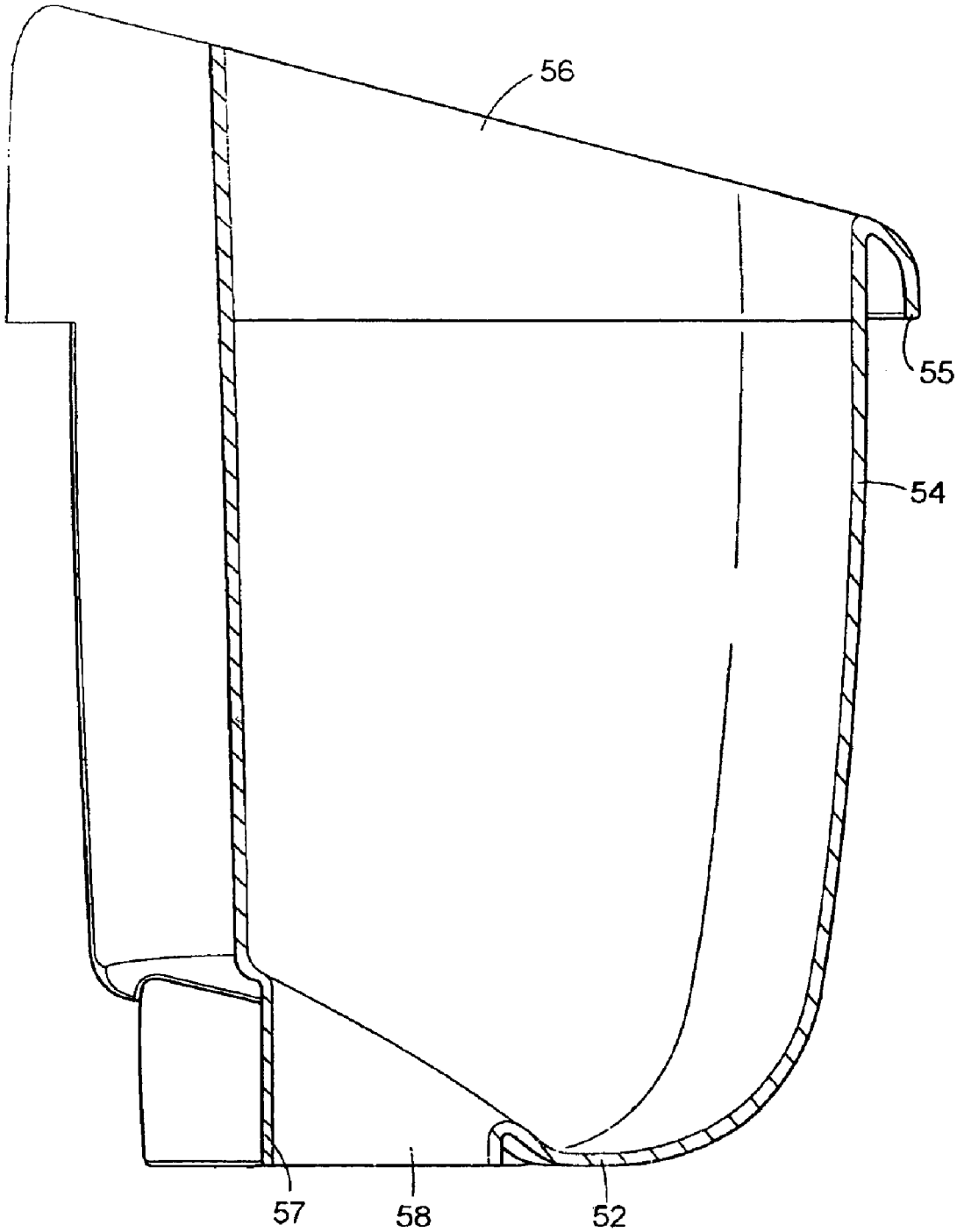
FIG. 4 is a sectional view of the basket of FIG. 2, taken along line 4—4 of FIG. 2.
Figure 5:
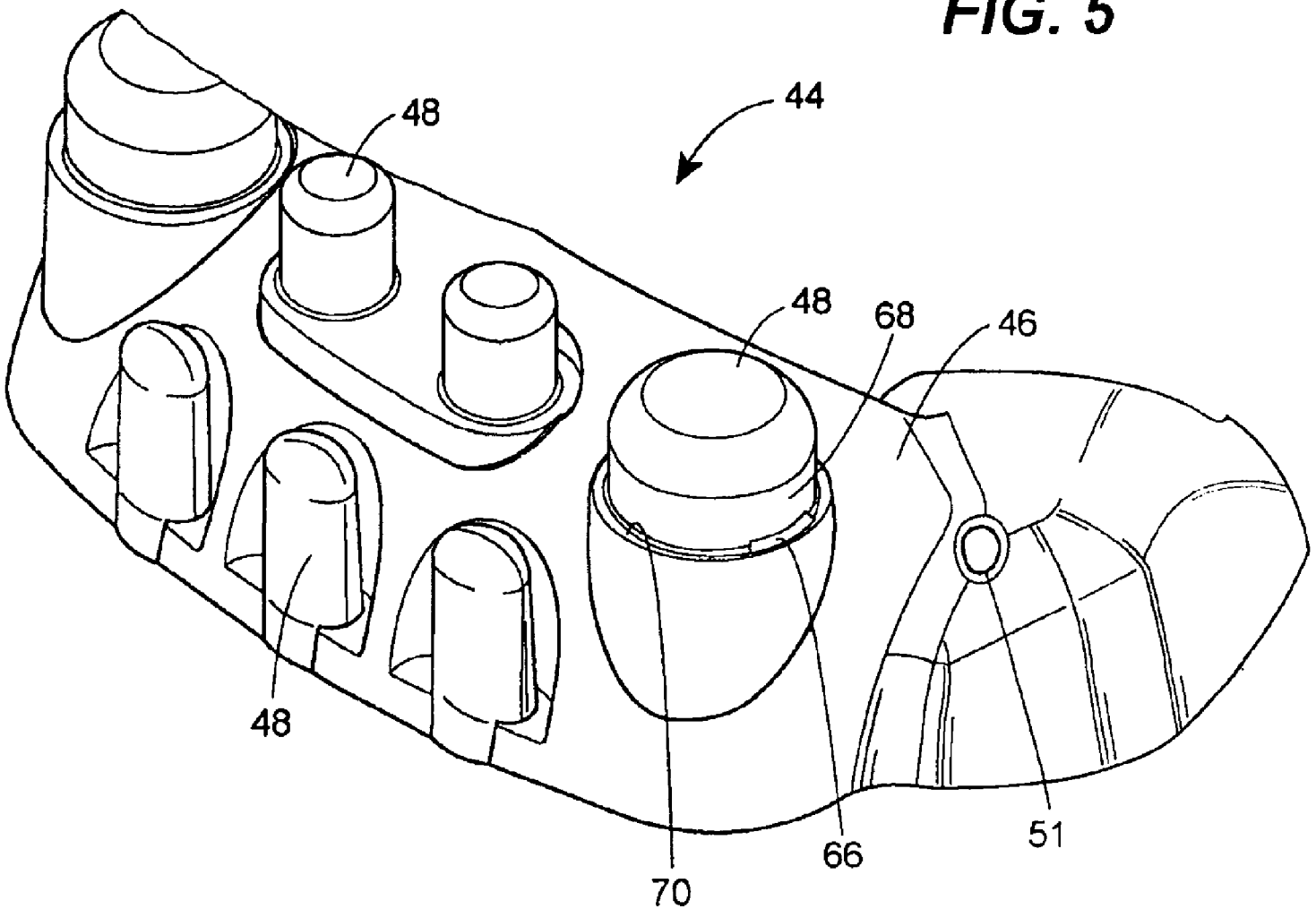
FIG. 5 is a perspective view of a tool caddy constructed in accordance with the teachings of the disclosure.
Figure 6:
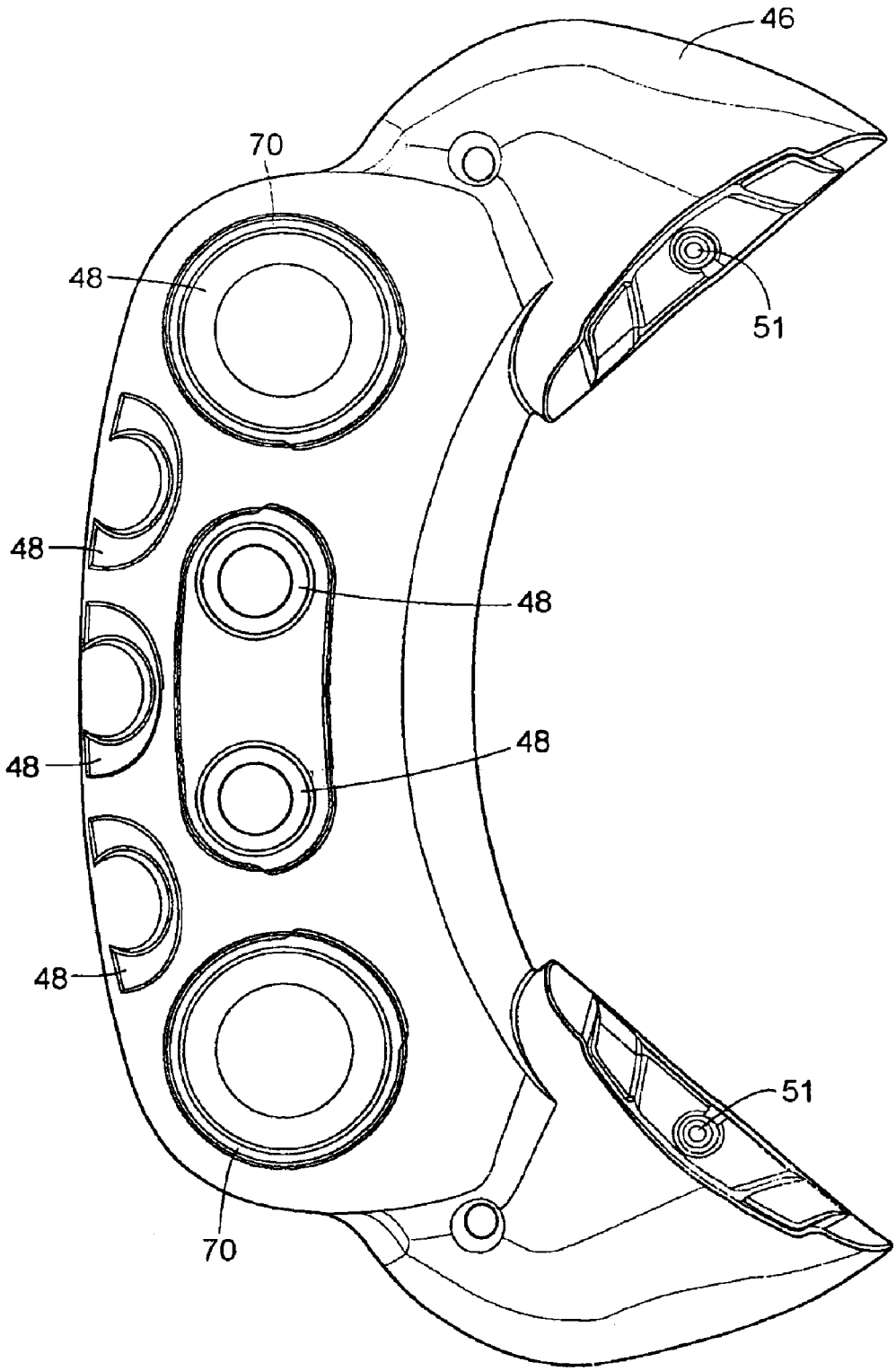
FIG. 6 is a top view of the tool caddy of FIG. 5.
Figure 7:
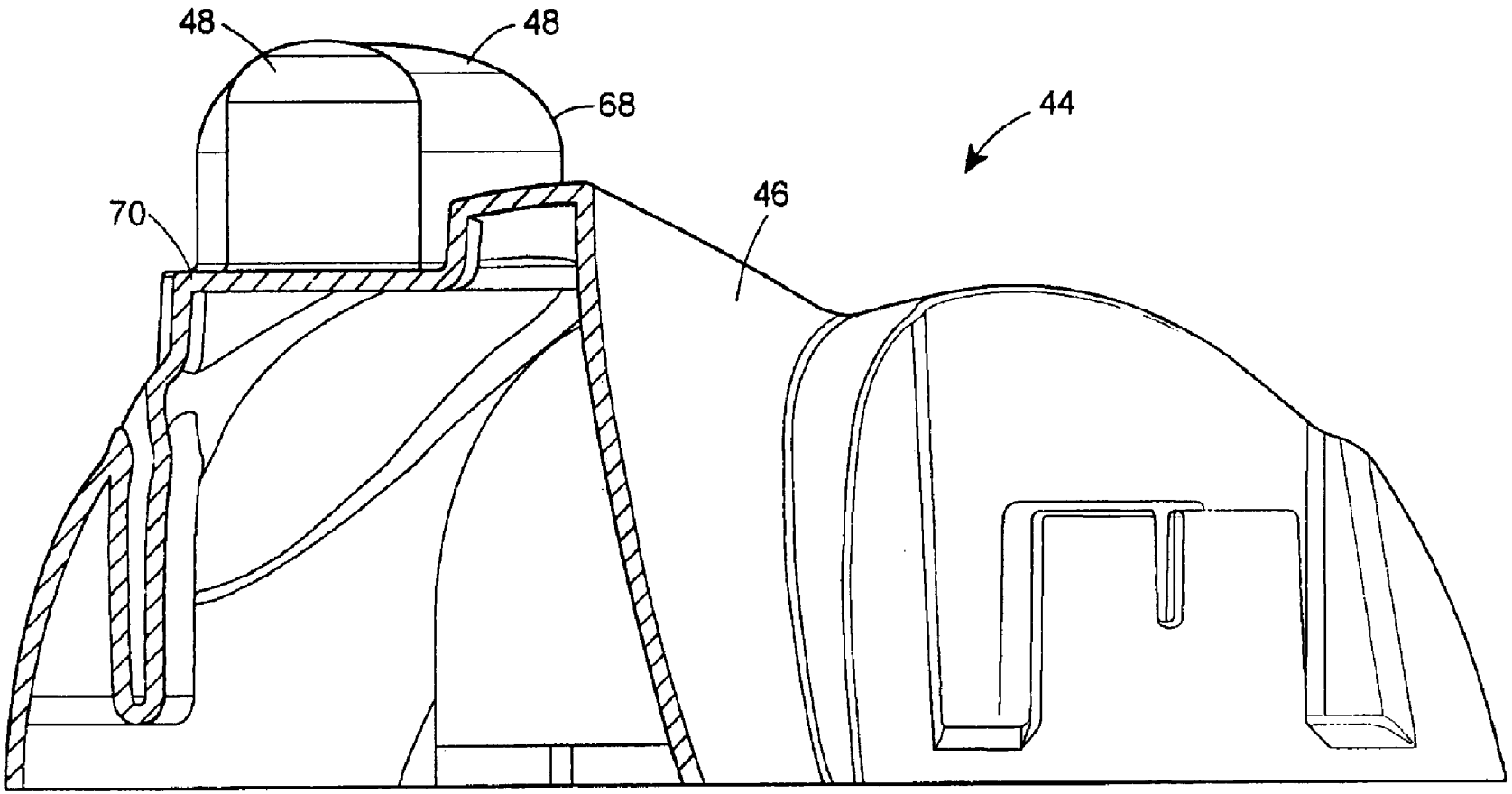
FIG. 7 is a sectional view of the tool caddy of FIG. 5, taken along line 7—7 of FIG. 5.
Figure 8:
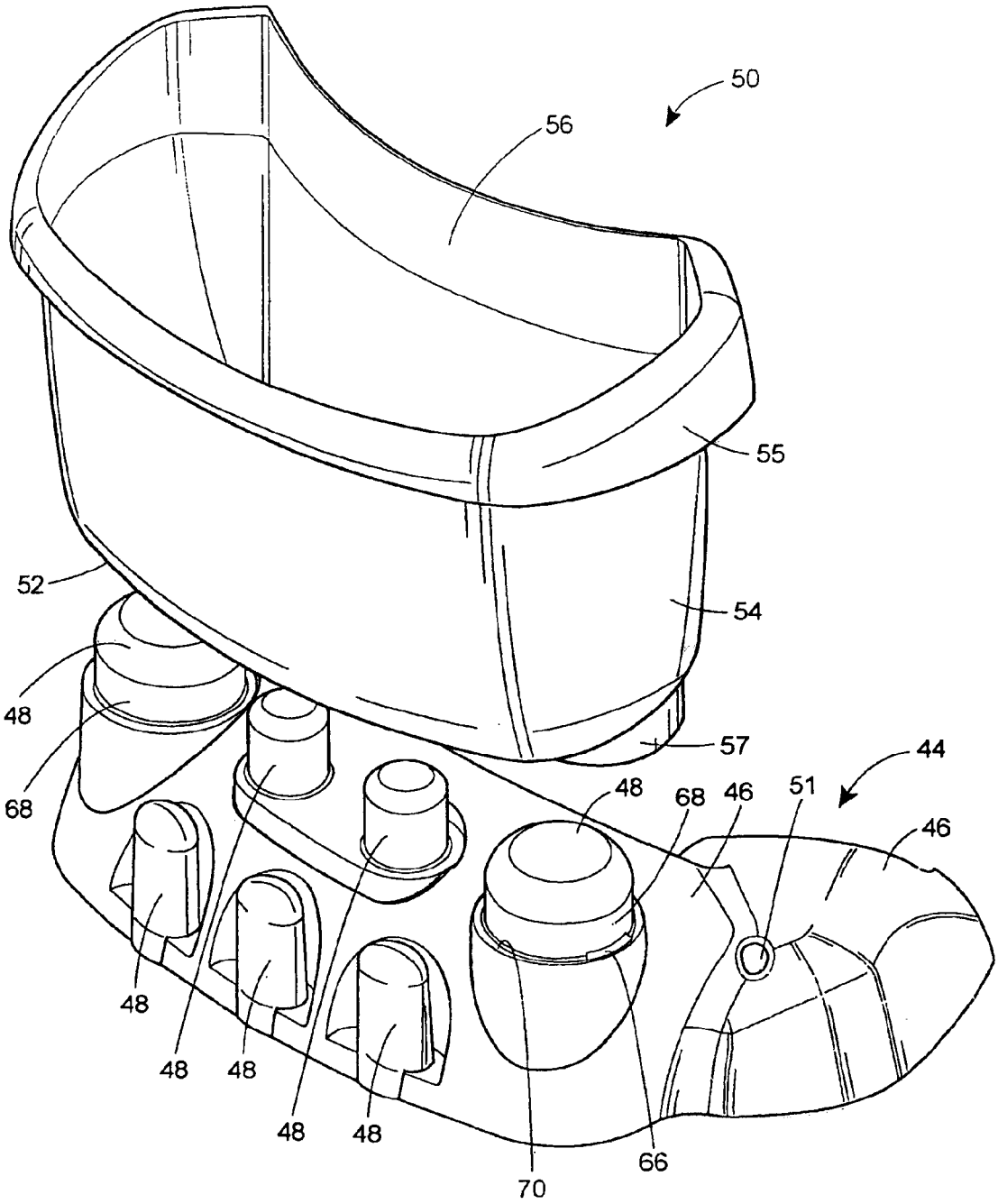
FIG. 8 is an exploded view of the basket and tool caddy assembly constructed in accordance with the teaching of the disclosure.

To accommodate storage of such tools (not shown), the vacuum cleaner 20 may be provided with a tool caddy 44. As shown best in FIGS. 2–4, the tool caddy 44 may include a base 46 from which a plurality of appendages 48 of various diameter and shape upwardly extend. Such appendages 48 are dimensioned so as to frictionally interfit with an opening with each of the tools. It will be noted that the base 46 includes a curved back wall 49 contoured to be continuous with the side wall 26 of tank 22. As is conventional, the tool caddy 44 includes attachment legs 51 adapted to attach to casters 32.

In addition to the tool caddy 44, the vacuum cleaner 20 includes a basket 50 (FIGS. 2–4) which may be provided to provide a relatively large receptacle for waste, tools, or any other item the user wishes to store therein. The basket 50 may include a bottom wall 52 from which a continuous side wall 54 upwardly extends terminating in a flange 55 and defines an open top 56. As shown best in FIG. 3, the bottom wall 52 includes a plurality of fenders 57 defining apertures 58 which are sized and spaced so as to be aligned with the plurality of appendages 48 when it is desired to mount the basket 50 onto the tool caddy 44. In so doing it can be seen that the basket 50 is nestable on top of the tool caddy 44. So as to provide for sufficient frictional engagement between the apertures 58 and the appendages 48, a plurality of deflectable leaves 60 may radially extend inwardly from some or all of the apertures 58. Such leaves 60 not only ensure frictional inter-engagement between the parts, but also allow for deviations in part size thereby allowing such parts to be manufactured to a relatively high tolerance.

Figure 9:
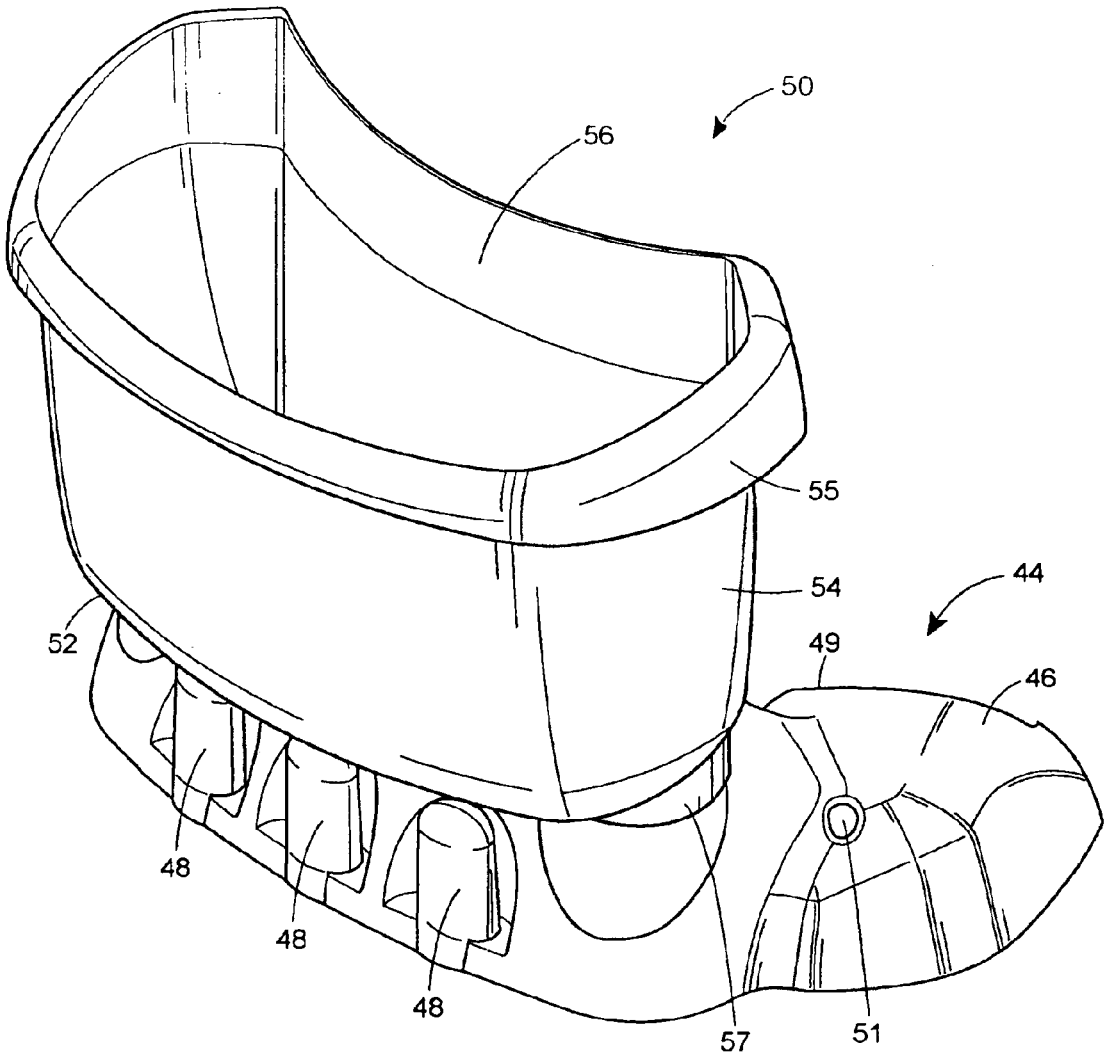
FIG. 9 is a perspective view of the basket mounted to the tool caddy in accordance with the teachings of the disclosure.
Figure 10:
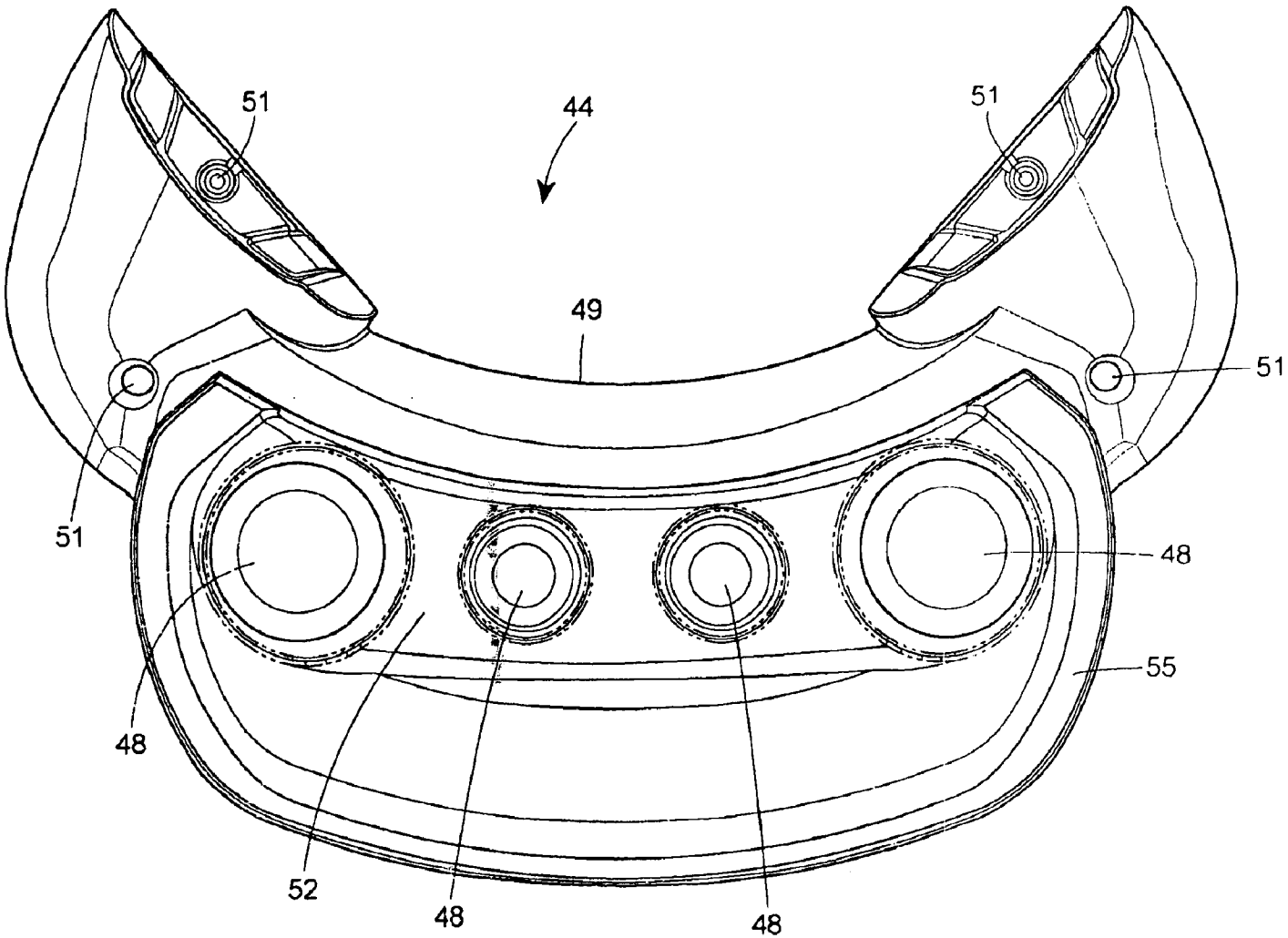
FIG. 10 is a top view of the assembly of FIG. 9.

Using such components, it will be noted in a comparison between FIGS. 9 and 10, that the basket 50 can be secured onto of the tool caddy 44 by first inserting the appendages 48 through the apertures 58 and then downwardly depressing the basket 50 onto the tool caddy 44 with the leaves 60 creating sufficient friction therebetween so as to secure the basket 50 onto the tool caddy 44.

Figure 11:
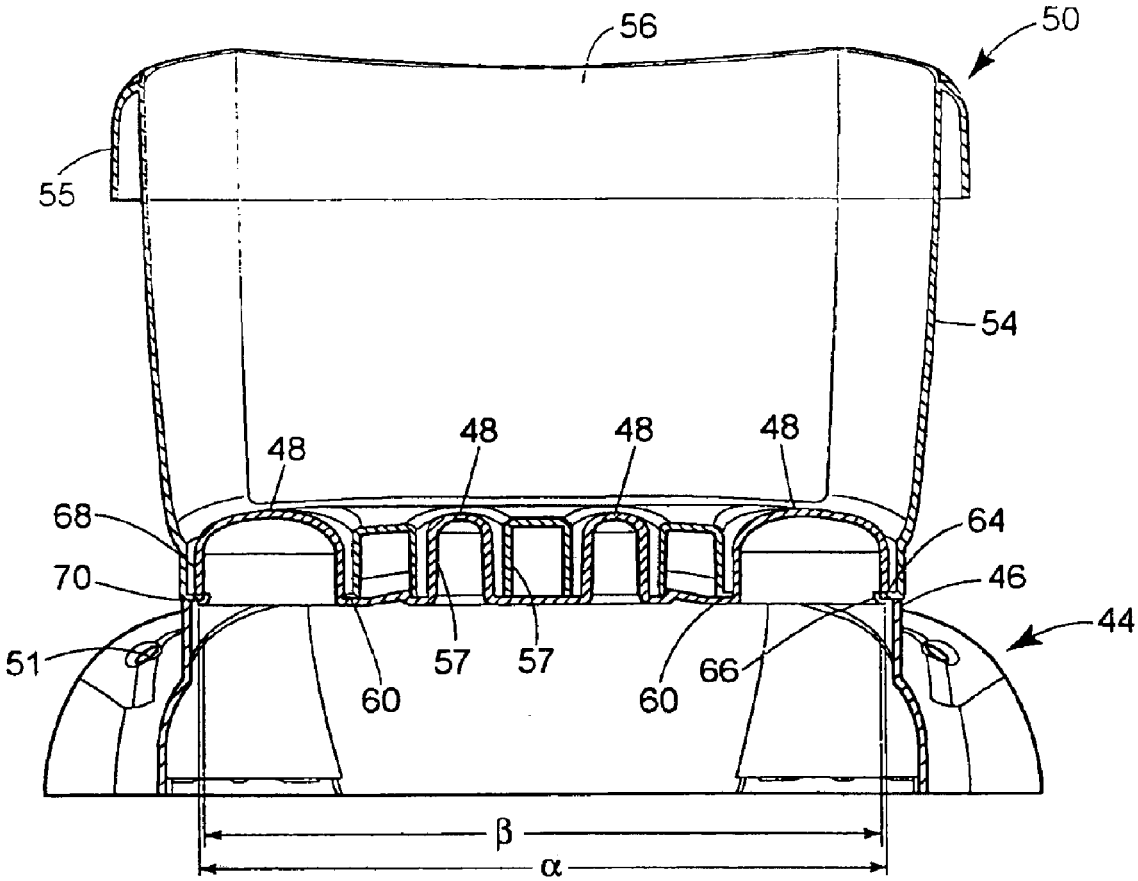
FIG. 11 is a sectional view of the assembly of FIG. 10, taken along line 11—11 of FIG. 10.
Figure 12:
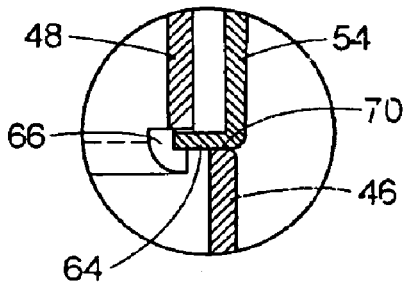
FIG. 12 is an enlarged cut away sectional view depicting a locking mechanism according to the teachings of the disclosure.

While such construction will allow the basket 50 to be mounted to the tool caddy 44, the present disclosure further provides a means by which the basket 50 can be securely locked onto or connected to the tool caddy 44 and in a positive fashion. More specifically, as shown best in FIGS. 11 and 12, it will be noted that a base 62 of the basket 50 may include at least one tab 64 extending radially inwardly at substantially a right angle to the base 62. Moreover, it will be noted again from FIG. 11 that the tool caddy 44 may include a number of slots 66 corresponding to the number of tabs 64. In the embodiment depicted in FIG. 11, it will be noted that first and second slots 66 are provided in the outermost appendages 48 of the tool caddy 44. Accordingly, the tabs 64 extend from the base 62 at an outer edge thereof. In further embodiments, it is of course possible to provide a fewer or a greater number of tabs and slots to secure the basket 50 to the tool caddy 44 at various degrees. Moreover, the tabs 64 can of course extend from the tool caddy toward the basket with the slots 66 being provided within the basket 50.

In order to facilitate insertion of tabs 64 into the slots 66, the tabs 64 are made to be deflectable. More specifically, as shown best in the enlarged cut-away view of FIG. 11, it will be noted that the inner diameter $\alpha$ (between tabs 64) is slightly less than the outer diameter $\beta$ (between the appendages 48 having slots 66). Accordingly, when the appendages 48 are inserted through the apertures 58 and the basket 50 is pushed down onto the tool caddy 44 the tabs 64 deflect radially outwardly and drag along an outer surface 68 of the appendages 48 until reaching the slots 66. Upon reaching the slots 66, the tabs 64 are allowed to snap back into their natural configuration and thus insert into the slots 66. In order to limit the downward motion of the basket 50 onto the tool caddy 44, the base 62 is provided with a shoulder 70 against which the tab 64 rests when the basket 50 is fully secured to the tool caddy 44. Accordingly, when the basket 50 is filled with debris, etc., the shoulder 70 is able to support the resulting load.

In order to remove the basket 50 from the tool caddy 44, sufficient force must be imparted in an upward direction to thus overcome the strength of the base 62 and tab 64 and thereby allow the tab 64 to again deflect radially outwardly, thus freeing the tab 64 from the slot 66. Moreover, since the basket 50 and tool caddy 44 may be manufactured from a resilient material, such as but not limited to polypropylene, the assembly and disassembly process is entirely repeatable.

While the foregoing describes the means for locking or connecting the basket to the tool caddy as a combination of deflectable tabs and slots it is to be understood that other mechanisms including, but not limited to, threads, nuts, bolts, snaps, clips, separate binders and ties, are included within the scope of this disclosure.

From the foregoing, one of ordinary skill will readily appreciate that the teaching of the disclosure can be used to construct a wet-dry vacuum cleaner having both a tool caddy and a waste receptacle or basket with a mechanism by which the waste basket can be securely and positively connected to the tool caddy.

What is claimed is:

1. A vacuum cleaner, comprising:

a tank having an outside wall;

a lid mounted to the tank;

a motor impeller unit mounted in the lid;

a tool caddy mounted to the outside wall, the tool caddy having at least one slot; and a basket removably mounted to the tool caddy, the basket including at least one deflectable tab adapted to frictionally interfit into the tool caddy slot, the basket further including a bottom wall from which a continuous side wall upwardly extends.

2. The vacuum cleaner of claim 1, wherein the tool caddy includes a plurality of upwardly extending appendages adapted to receive vacuum implements thereon and the basket includes a plurality of apertures, the appendages being received in the apertures when the basket is mounted to the tool caddy.

3. The vacuum cleaner of claim 2, wherein the tool caddy slot is provided within the tool caddy appendages.

4. The vacuum cleaner of claim 3, wherein the tool caddy and basket are manufactured from plastic, the deformable tab being integrally molded with the basket.

5. The vacuum cleaner of claim 4, wherein the basket includes at least two slots, and the tool caddy includes at least two tabs.

6. The vacuum cleaner of claim 4, wherein the tab extends orthogonally from a base of the basket.

7. The vacuum cleaner of claim 6, wherein the base includes a shoulder, the slot extending into the appendage directly above the shoulder.

8. A method of assembling accessories onto a wet-dry vacuum cleaner, comprising:

mounting a tool caddy onto a tank of a wet-dry vacuum cleaner, the tool caddy having a plurality of upwardly extending appendages, at least one of the appendages including a slot;

mounting a basket on top of the tool caddy, the basket having a continuous side wall extending upwardly from a bottom wall and defining an open top, the bottom wall including a plurality of apertures, each of the apertures receiving one of the tool caddy appendages when the basket is mounted onto the tool caddy, the basket including a tab; and positively connecting the basket with the tool caddy by engaging the tab into the slot.

9. The method of claim 8, wherein the tab is engaged into the slot by pushing the basket onto the tool caddy and thereby deflecting the tab outwardly until reaching the slot.

10. The method of claim 9, wherein the pushing step is performed so as to deflect at least two tabs into at least two slots.

11. A wet-dry vacuum cleaner, comprising:

a tank having a bottom wall and an continuous sidewall extending upwardly from the bottom wall, the sidewall defining an open top;

a lid mounted to the open top;

a motor impeller unit mounted in the lid;

a tool caddy mounted against the tank sidewall, the tool caddy having a plurality of appendages adapted to store vacuum tool accessories;

a basket mounted to the tool caddy, the basket including a bottom wall from which a sidewall upwardly extends; and means for locking the basket onto the tool caddy.

12. The wet-dry vacuum cleaner of claim 11, wherein the means for locking includes at least one deflectable tab adapted to be inserted into at least one slot.

13. The wet-dry vacuum cleaner of claim 12, where the tab extends from one of the basket and tool caddy, and the slot is provided in the other of the basket and tool caddy.

14. The wet-dry vacuum cleaner of claim 12, wherein the means for locking further includes a shoulder on the tool caddy.

15. The wet-dry vacuum cleaner of claim 11, wherein the means for locking includes at least two deflectable tabs adapted to be inserted into at least two slots.

16. A wet-dry vacuum cleaner, comprising:

a tank having an open top;

a lid mounted to the open top;

a motor impeller unit mounted in the lid;

a tool caddy mounted to the wet-dry vacuum cleaner tank, the tool caddy having a plurality of appendages adapted to receive and store vacuum cleaner tools and accessories;

a basket adapted to be mounted on top of the tool caddy, the basket having a bottom wall from which a continuous sidewall upwardly extends, the bottom wall having a plurality of apertures adapted to receive the plurality of tool caddy appendages; and at least one tab extending from one of the tool caddy and basket, the other of the tool caddy and basket including a slot adapted to receive the tab.

17. The wet-dry vacuum cleaner of claim 16, wherein the tab extends from the basket and the slot is provided in the tool caddy.

18. The wet-dry vacuum cleaner of claim 17, wherein the tool caddy includes a shoulder, the tab abutting the shoulder when inserted through the slot.

19. The wet-dry vacuum cleaner of claim 17, wherein at least two tabs extend from the basket and at least two slots are provided in the tool caddy.

20. The wet-dry vacuum cleaner of claim 16, wherein the tank is substantially cylindrical and the tool caddy and basket are contoured to be continuous with the tank.

* * * * *